US005628626A

United States Patent [19]

Hansen

[11] Patent Number: 5,628,626

[45] Date of Patent: May 13, 1997

[54] HYDRAULIC MACHINE

[75] Inventor: Gunnar L. Hansen, Nordborg, Denmark

[73] Assignee: Danfoss A/S, Nordborg, Denmark

[21] Appl. No.: 532,705

[22] PCT Filed: Mar. 24, 1994

[86] PCT No.: PCT/DK94/00124

§ 371 Date: Oct. 3, 1995

§ 102(e) Date: Oct. 3, 1995

[87] PCT Pub. No.: WO94/23206

PCT Pub. Date: Oct. 13, 1994

[30] Foreign Application Priority Data

Apr. 5, 1993 [DE] Germany ..... 43 11 165.3

[51] Int. Cl.[6] ..... F04C 18/10

[52] U.S. Cl. ..... 418/61.3; 418/150; 418/171

[58] Field of Search ..... 418/61.3, 150, 418/166, 171

[56] References Cited

U.S. PATENT DOCUMENTS 3,424,095 1/1969 Hansen ..... 418/61.3

4,504,202 3/1985 Saegusa .

4,518,332 5/1985 Saegusa .

4,673,342 6/1987 Saegusa .

5,368,455 11/1994 Eisenmann ..... 418/171

*Primary Examiner*—Charles G. Freay

*Attorney, Agent, or Firm*—Lee, Mann, Smith, McWilliams, Sweeney & Ohlson

[57] ABSTRACT

A hydraulic machine is disclosed, with a gearwheel, which has a midpoint (6) and a predetermined number of external teeth, and an annular gear, which has a midpoint (7) offset by an eccentricity (E) with respect to the midpoint (6) of the gearwheel and a number of internal teeth which exceeds by one the number of external teeth, the gearwheel and annular gear orbiting and/or rotating relative to one another and at least the form of the external teeth being created using a set of circles (30, 30'; 35, 35') lying with their midpoints (P1-P6; P1'-P6') on a trochoid (36, 37). It is desirable for the efficiency, service life and noise properties of such a machine to be improved. To that end, at least two trochoids (36, 37), displaced relative to one another in the circumferential direction, are provided for generating a tooth profile, the rolling circles (28, 33) of which and the base circles (27, 32) of which differ from one another.

16 Claims, 4 Drawing Sheets a)

HYDRAULIC MACHINE

Figure 1A:
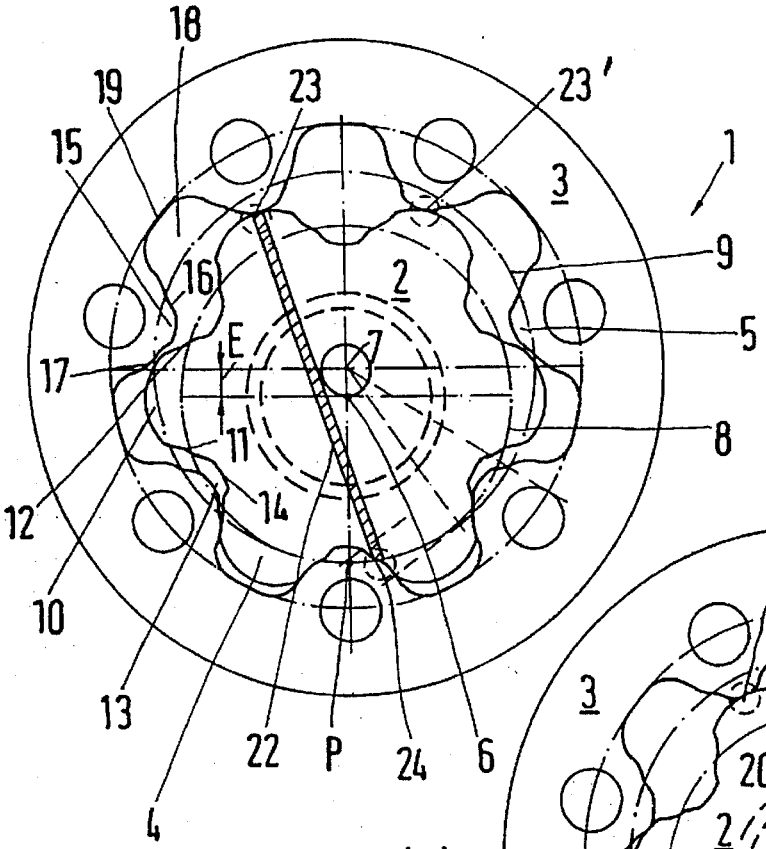

The invention relates to a hydraulic machine with a gearwheel, which has a midpoint and a predetermined number of external teeth with tooth tips and tooth flanks separated by tooth spaces, and an annular gear, which has a midpoint offset by an eccentricity with respect to the midpoint of the gearwheel and a number of internal teeth with tooth tips and tooth flanks separated by tooth spaces which exceeds by one the number of external teeth, the gearwheel and annular gear orbiting and/or rotating relative to one another and at least the form of the external teeth being created using a set of circles lying with their midpoints on a trochoid.

Such a machine is known, for example from U.S. Pat. No. 2,421,463. The (n+1) internal teeth of the annular gear consist either of free cylindrical rollers or of fixed cylinder segments. The n external teeth of the gearwheel are produced by a set of circles, the circles of which lie with their midpoints on a cycloid. The cycloid is created in that a rolling circle rolls on a base circle without slipping, the base circle having a diameter n-times that of the rolling circle. The cycloid is generated from a point in the rolling circle which is spaced a distance from the centre of the rolling circle corresponding to the eccentricity.

The same cycloid can also be created (FIG. 2) in that a different pair of circles (RH, RK) roll on one another; here the rolling circle (RK) encloses the base circle (RH) (Dubbel, 13th edition, 1970, page 144, FIG. 138).

In the known machine, all the teeth of the gearwheel mesh simultaneously with the corresponding teeth of the annular gear. As many chambers sealed with respect to one another are formed as there are internal teeth in the annular gear. In theory only two pressure regions separated from one another are necessary, however, of which one is pressurized with the pressure on the discharge side and the other is pressurized with the pressure on the inlet side. The larger number of contact points can lead to overdefinition of the system and thus to an increase in leakages. The known construction is also unfavourable because in one position, in which two tooth tips of an internal tooth and an external tooth lie opposite one another, a good seal is required between the pressures on the discharge and inlet sides, but in the opposing region forces between the gearwheel and the annular gear have to be accommodated. In this position, the gearwheel is, as it were, clamped in the annular gear. The tip of the external tooth touches the bottom land of the tooth space, which leads to tangential contact between tooth tip and bottom land (see FIG. 1*a*). This contact is poorly suited to transfer of forces. The transfer of force between gearwheel and annular gear on the opposite side is effected by line contact between two convex surfaces of relatively small radius of curvature, which leads to high Hertzian stresses. This can lead to damage to the lubricating film and consequently to increased friction, which, if it does not result in lasting damage, significantly reduces the efficiency of the machine.

The invention is therefore based on the problem of improving the efficiency, service life and noise properties of a machine of the kind mentioned in the introduction.

This problem is solved in a hydraulic machine of the kind mentioned in the introduction in that there are provided at least two trochoids, displaced relative to one another in the circumferential direction, for generating a tooth profile, the rolling circles of which and the base circles of which differ from one another.

The tooth form of the external teeth of the gearwheel is now no longer determined exclusively by a single trochoid on which the set of curves is arranged. On the contrary, at least two trochoids are provided. The form of the teeth can thereby be changed, in order, for example, to avoid unnecessary contact between external teeth and internal teeth, without having to forfeit the advantageous effect of tooth generation by means of trochoids. It is not only the base circles of the trochoids, of which there are at least two, that differ, but also the rolling circles, so that it is possible here to ensure that the required periodicity is maintained, regardless of which of the different trochoids is being used to generate the tooth form.

In a preferred embodiment, a first trochoid is essentially only the basis of the set of circles for forming the tooth tips of the external teeth. The tooth tips of the external teeth co-operate with the tooth tips of the internal teeth to form a first sealing region which is responsible for the seal between the discharge side and the inlet side. The trochoid-based set of circles can now be selected exclusively with a view to optimizing this sealing region, that is, for example, to keep the Hertzian stresses in this region as small as possible and to optimize the formation of the lubricating film.

It is also an advantage for the tooth tips of external teeth and internal teeth to have substantially the same curvature. With the large radius of curvature now possible, this allows a relatively large sealing area which, together with the hydraulic fluid, enables a relatively large-area sealing zone to be formed. The hydraulic resistance in a gap possibly present between the tooth tips becomes relatively large, which reduces leakage. The volumetric efficiency can consequently be increased. No heed need be paid to how the tooth flanks would behave with the same trochoid. Other curves can be used for the tooth flanks and the tooth spaces. The first trochoid is used until the gearwheel has rotated sufficiently far in relation to the annular gear that the tooth tip no longer needs to fulfil its sealing function.

It is also preferred for adjacent trochoids to change discontinuously into one another at a transition point. This has a beneficial effect on the side lying opposite the sealing point formed by the opposing tooth tips. Large forces have to be transferred here, and a seal is effected automatically. The transition point provides improved possibilities in arranging the flank engagement of the teeth of the gearwheel and annular gear. Through this, for example, undesirable or unsuitable sections on the tooth or tooth flank or the tooth space can be skipped over, without the force transfer or the seal being adversely affected thereby.

It is especially preferred for the difference at the transition point between the distance of the first trochoid from the contact point of two rolling circles of gearwheel and annular gear and the radius of the associated set of circles to be substantially the same as the difference between the distance of the adjacent trochoid from the contact point and the radius of the associated set of circles. During the change over from one trochoid to another as a basis for the sets of circles, there are then neither jumps nor discontinuities nor sharp edges in the tooth form. On the contrary, at the transition point in the tooth form there is an imperceptible change from one trochoid to the other, since the tangents of the respective circles of the sets of circles are identical at this point.

Advantageously, at least in one position, in which an external tooth and an internal tooth form a sealing point in the region of their tooth tips, the opposing sealing point is displaced from a diametral line towards a tooth flank region. This precludes a tooth tip having to come into contact at this sealing point with a tooth space bottom land, which has the disadvantages mentioned in the introduction. The forces can be absorbed considerably better in the flank region, since here two surfaces lie one against the other.

It is here especially preferable for a contact to be formed between two surfaces in the flank region, one of which is convexly curved and the other of which is concavely curved. The two surfaces therefore lie, shell-like, one inside the other. Despite a high force that has to be absorbed by the surfaces, the force per unit area can be kept relatively low since the force is distributed over a relatively large area.

Advantageously, circumferential sections are provided, in which the tooth form is formed by base forms other than trochoid-based sets of circles. The trochoids, of which there are at least two, do not therefore cover the entire circumference of the gearwheel or the annular gear. The tooth forms can also have different curvatures where this is an advantage.

In that case it is especially preferable for the other curve forms to be formed by segments of a circular curve. Segments of a circular curve can be produced very easily by rotating tools. In particular in those regions in which there is no contact anyway between gear wheel and annular gear, the tooth form merely requires to be constructed so that free movement of the annular gear and gearwheel relative to one another is possible. Contact at the necessary points enables an optimum seal to be achieved with this construction.

Advantageously, the two parts gear wheel and annular gear are supplemented in that the circumferential sections of the one part, which are formed by the other curve forms, are associated with circumferential sections of the other part, the form of which is constituted by a set of circles lying with their midpoints on a trochoid. In this way, at every contact between the gearwheel and the annular gear a configuration is produced in which a trochoid-based curve form engages with a different curve form. This guarantees that gearwheel and annular gear are able to move relative to one another virtually without loss or with very small losses.

Advantageously, the tooth tips of the internal teeth are in the form of a section of a cylinder, the radius of which is determined by the radius of the base circle of the trochoid for generating the tooth tips of the external teeth and by the eccentricity. It is therefore possible for the tooth tips to have an approximately identical curvature.

The radius of the section of a cylinder is advantageously defined by the following equation:

$$RZ = \frac{(RC + (n+1) \times E)^2}{2 \times (RC + (n+1)^2 \times E)}$$

in which

RZ is the radius of the section of a cylinder,

RC is the radius of a midpoint circle for a sector of teeth of the annular gear, E is the eccentricity, and n is the number of teeth in the gearwheel.

In a preferred embodiment, the tooth tips of the internal teeth extend over an angle of rotation that corresponds to a movement of the contact point of the two rolling circles over approximately half a tooth pitch. The angular range is therefore dependent on the tooth tip curvatures.

An advantageous shaping of the tooth flank occurs when the inclination of the tooth flank of the internal tooth at the end point of the tooth space bottom land corresponds to a normal on a tangent to the rolling circle of the annular gear which passes through the end point of the bottom land. This produces a steep inclination in the tooth flank and consequently a favourable force transfer. If the normal is not set up on a tangent, but on a secant, this is also possible in principle, but produces a shallower tooth flank.

Accordingly, it is preferable for the inclination of the tooth flank at the end point of the tooth tip of the internal tooth to correspond to a radial ray through the midpoint of the rolling circle. This also produces a very steep tooth flank, without undercuts or similar problems occurring. A flatter tooth flank can also be used here.

The transition between these two flank sections, that is to say, between the end points of tooth tip and bottom land, is expediently effected in the form of an S-curve. The S-curve merges tangentially into the above described flank sections and compensates for the different slopes.

It is also possible to provide pockets in the bottom lands of gear wheel and/or annular gear. Oil under pressure, which assists sealing of the gearwheel on the opposite side starting from the pocket, can collect in these pockets, or a connection for the admission of hydraulic fluid can be provided at these pockets. The term "oil under pressure" means that hydraulic fluid which has been pressurized is involved here.

Figure 1B:
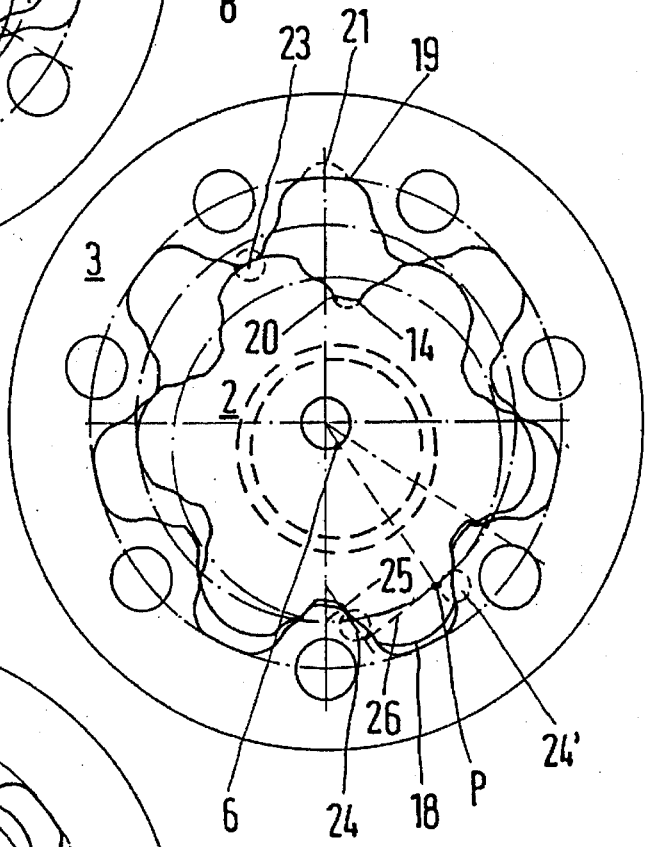
Figure 1C:
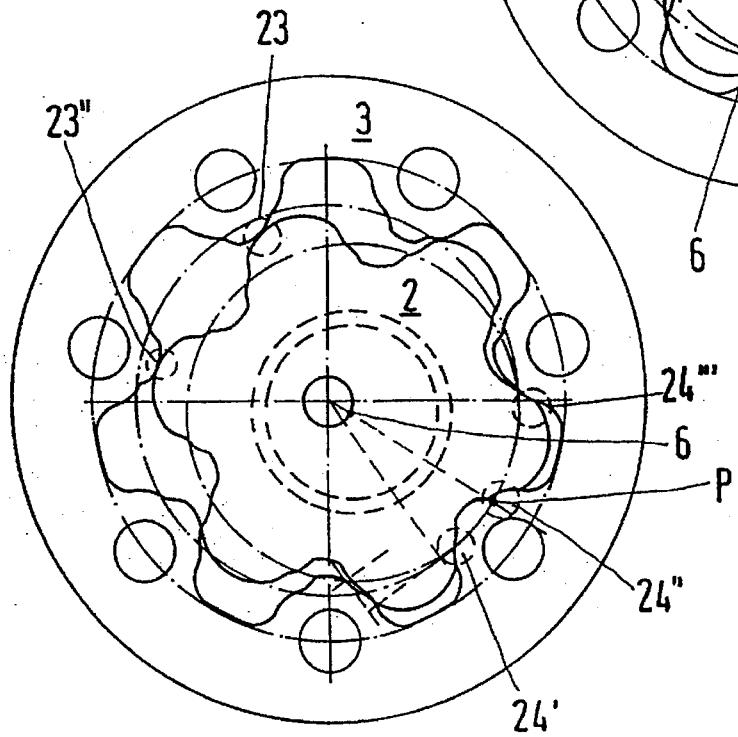
Figure 2:
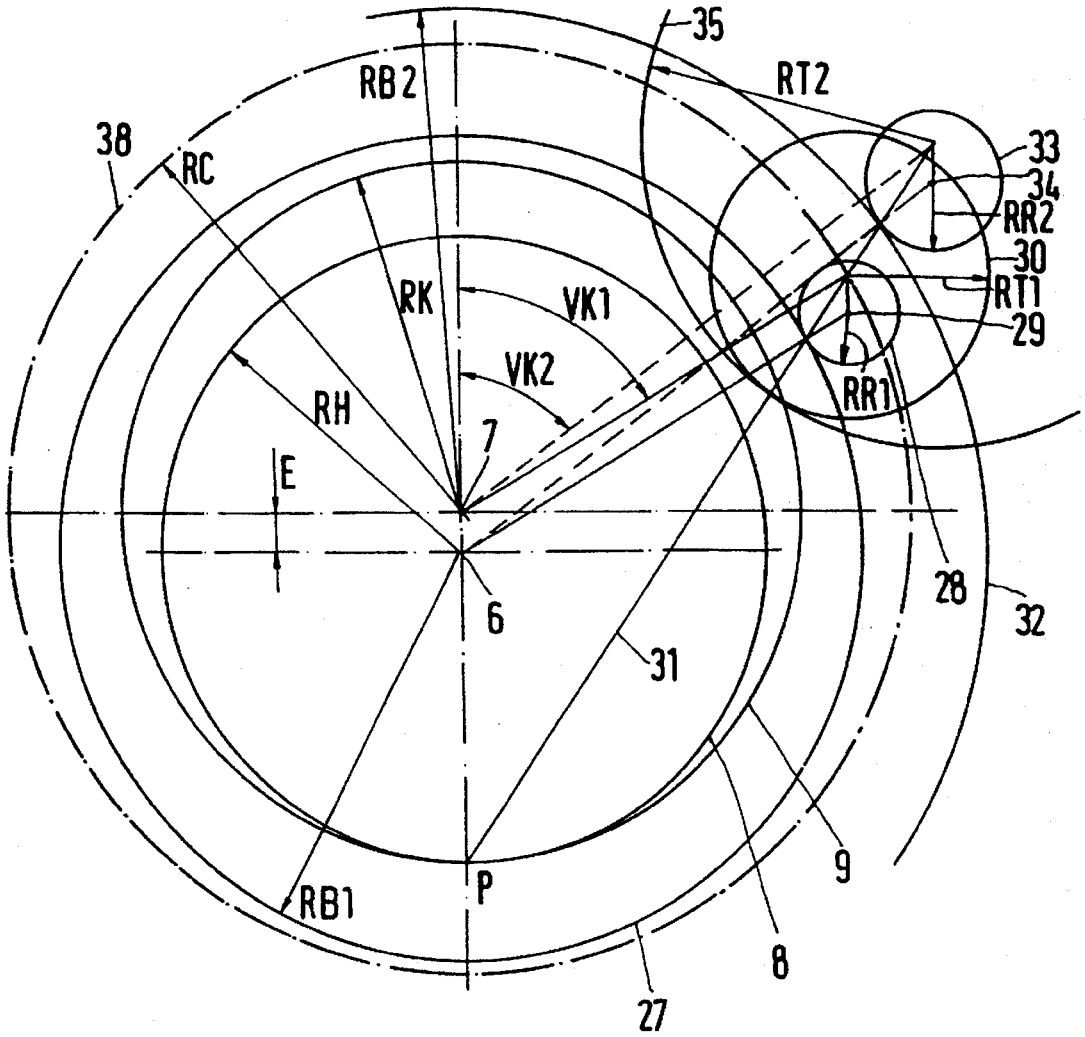
Figure 3:
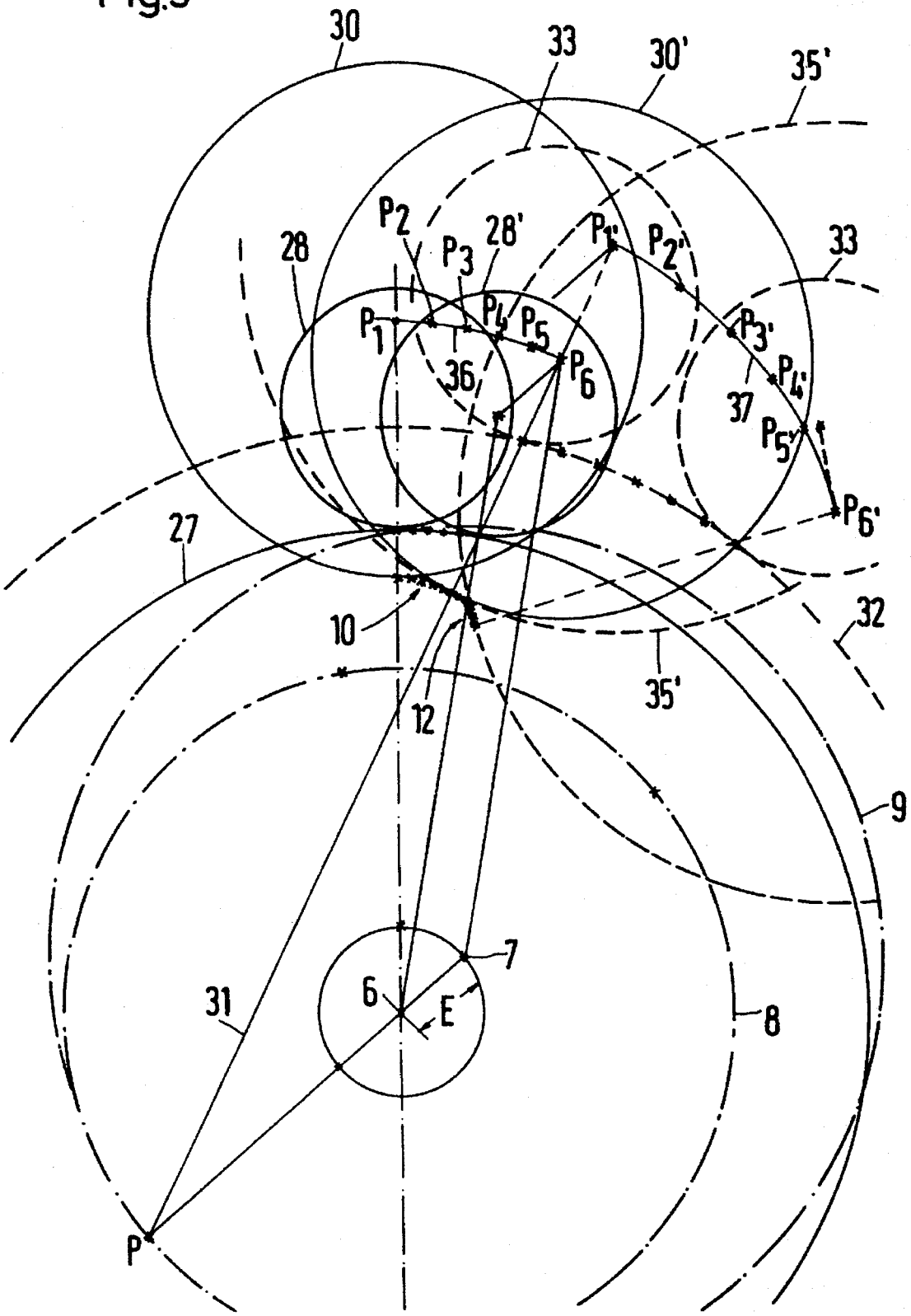
Figure 4:
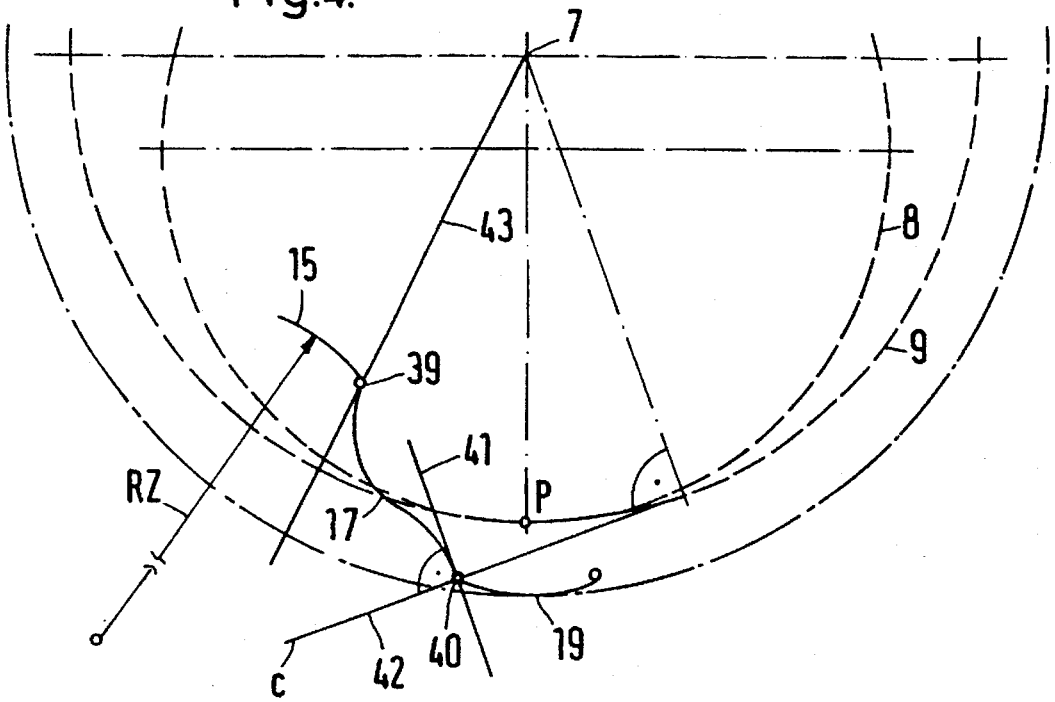
Figure 5:
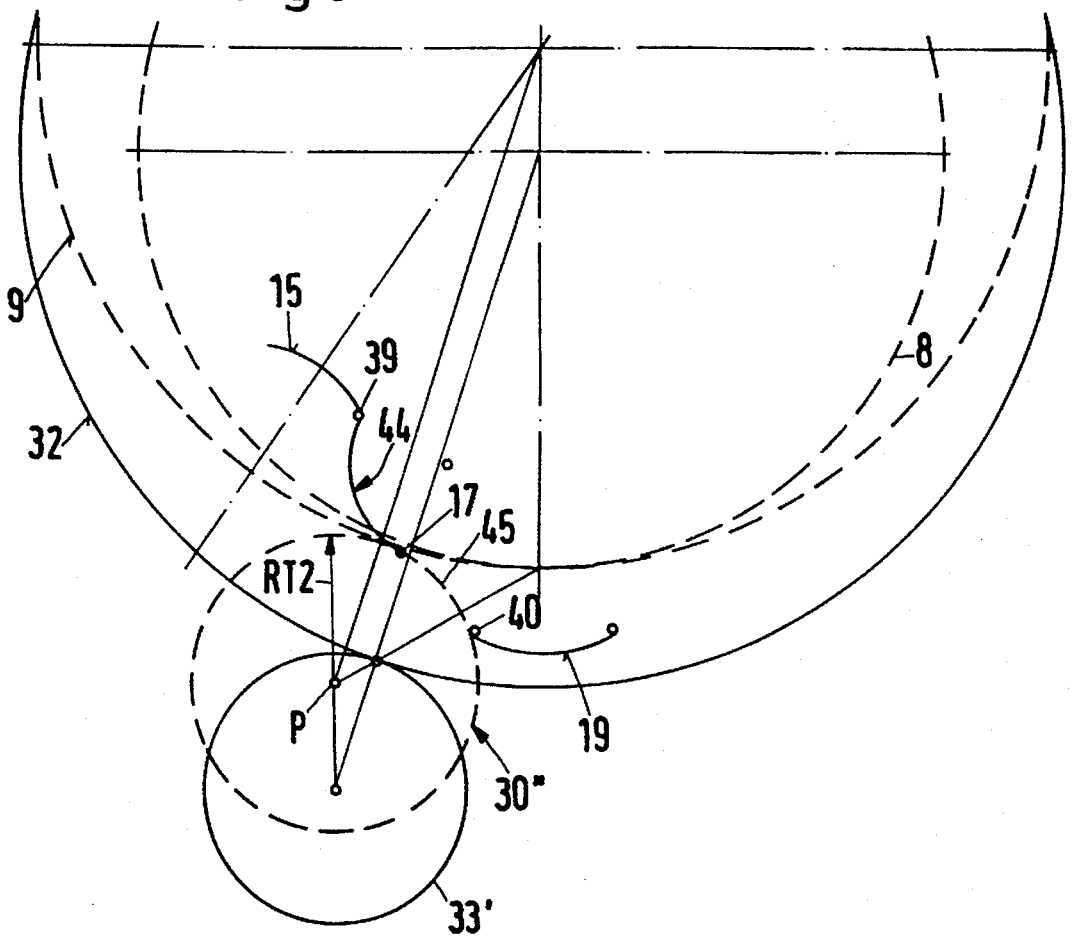

The invention is described hereinafter with reference to preferred embodiments in conjunction with the drawings, in which FIGS. 1(*a–c*) is a diagrammatic illustration of the machine with three different gearwheel positions, FIG. 2 is a diagrammatic illustration to describe the variables used for construction, FIG. 3 illustrates two different trochoids for constructing the form of a tooth, FIG. 4 is a diagrammatic illustration of the flank steepness of the internal teeth of the annular gear, and FIG. 5 is a diagrammatic illustration to explain the construction of the tooth flanks of the internal teeth of the annular gear.

A hydraulic machine 1 has a gearwheel 2 and an annular gear 3. The gearwheel has n external teeth 4, in this particular case six external teeth 4. The annular gear 3 has n+1 internal teeth 5, in this particular case, seven. The number of internal teeth 5 is therefore always one more than the number of external teeth 4. The gearwheel has a midpoint 6. The annular gear has a midpoint 7. Both midpoints 6, 7 are offset with respect to one another by an eccentricity E. In operation, the gearwheel 2 rotates about its midpoint, whereas it orbits around the midpoint 7 of the annular gear 3.

The movement of gearwheel 2 and annular gear 3 can be represented by a rolling circle 8 for the gearwheel 2 and a rolling circle 9 for the annular gear 3. Here, the rolling circle 8 rolls anticlockwise in the rolling circle 9, the rolling circle 8 itself rotating in a clockwise direction.

Each external tooth 4 has a tooth tip 10 and tooth flanks 11, 12. Adjacent external teeth 4 are separated by tooth spaces 13 with a bottom land 14. The same applies to the internal teeth 5. Each internal tooth 5 has a tooth tip 15 and two tooth flanks 16, 17. Adjacent internal teeth 5 are separated from one another by a tooth space 18 with a tooth bottom land 19. As shown only in FIG. 1*b*, pockets 20, 21 for oil under pressure can be provided in the bottom lands 14, 19; as the gearwheel 2 rotates relative to the annular gear 3, these pockets receive displaced hydraulic fluid, which is pressurized here, or serve to feed hydraulic fluid to the appropriate chamber. It goes without saying that the pockets for oil under pressure can be provided for all bottom lands 14, 19 of the gearwheel 2 and/or annular gear 3, and not just for a single tooth space in the gearwheel 2 and a single tooth space in the annular gear 3, as illustrated in FIG. 1*b*.

The gearwheel 2 divides the inner space of the annular gear 3 into two separate pressure regions. In FIG. 1*a* the division is indicated diagrammatically by a hatched bar 22. The hatched bar 22 is the connection of a first sealing point 23 between a tooth tip 10 of an external tooth 4 and a tooth tip 15 of an internal tooth 5 and a second sealing point 24 between two tooth flanks 17 and 12 respectively of an internal tooth 5 and an external tooth 4. In FIG. 1*a*, the seal between the two tooth tips is in the process of changing from the point 23' to the point 23. In FIG. 1*b*, in which the gearwheel 2 has been rotated further with respect to the annular gear 3 (compare the position of the contact point P on the rolling circles 8, 9), the sealing point 23' has disappeared. In the tooth tip-to-tooth tip region there is there only the sealing point 23. On the side of the gearwheel 2 opposite the sealing point 23 the seal is being effected at the second sealing point 24 between two tooth flanks. The second sealing point 24 is therefore displaced with respect to a diametral line towards the tooth flanks. There is consequently no need for contact between tooth tip 10 of the external tooth 4 and the bottom land 19 of the annular gear 3. As can be seen from a comparison of FIGS. 1*a* to 1*c*, the second sealing point 24 travels back and forth on the tooth flank 17 of the internal tooth between an upper limit 25 and a lower limit 26. Outside these two limits there is no contact between the tooth flank 17 of the internal tooth 5 and the tooth flank 12 of the external tooth 4. Identical limits can be found on the opposite tooth flanks 16 and 11. The second sealing point 24 is therefore formed by a face-to-face contact of two flank faces, one of the two faces being convex and the other of the two faces being concave. As will be explained in conjunction with FIG. 5, the tooth flank is in the form of an S-curve. The same is then also true of the tooth flank of the external tooth 4.

FIG. 1*b* shows a position of the gearwheel 2 in which the seal is just in the process of changing from the sealing point 24 to the sealing point 24' on the other flank of the tooth space 18. For a brief moment there are two sealing points here. Hydraulic fluid which has been trapped in the tooth space 18 then exerts a pressure on the gearwheel 2 to improve the seal at the first sealing point 23. As the gearwheel 2 continues to roll in the annular gear 3, it reaches the position illustrated in FIG. 1*c*. In so doing, the tooth tip-to-tooth tip seal of the sealing point 23 changes over to the sealing point 23". The opposite tooth flank-to-tooth flank seal has shifted from the sealing and force transfer point 23' to the sealing point 24", whereas the force transfer point has shifted to the point 24''', with the result that a desired engagement factor is achieved. The pressure in the chambers formed by the external teeth 4 and the internal teeth 5 is controlled by a known slide member, not illustrated, that is to say, the individual chambers are connected in the correct sequence to a source of pressure, for example, a pump, or to a pressure sink, for example, a tank.

The curvature of the tooth tip 15 of the internal tooth 5 corresponds to the curvature of a portion of the envelope of a cylinder; the radius of the associated cylinder can be approximately determined by the following equation for instance:

$$RZ = \frac{(RC + (n+1) \times E)^2}{2 \times (RC + (n+1)^2 \times E)}$$

in which

RZ is the radius of the cylinder,

RC is the radius of a midpoint circle for a sector of teeth of the annular gear 3, n is the number of teeth in the gearwheel 2, and E is the eccentricity.

RC is a radius which is explained in more detail in conjunction with FIG. 2. This radius RC (=RB1+RR1) corresponds to the base circle 27 enlarged by the ratio of the number of teeth between the annular gear 3 and the gearwheel 2, which is used to generate the trochoid used for forming the tooth tip 10 of the external teeth 4. In this way the curvature of the two tooth tips 10, 15 of external tooth 4 and internal tooth 5 can be kept substantially the same, so that the contact stresses, in particular the Hertzian stresses, remain low. At the same time, the sealing point 23 becomes relatively long, so that here a very good seal-forming approximation of the two tooth tips 10, 15 is achieved. The hydraulic resistance for the hydraulic fluid becomes relatively large, which keeps possible leakage very small. Possible wear is shared uniformly between the two components gearwheel 2 and annular gear 3.

In FIG. 2, several further variables used to construct the machine 1 are explained in more detail. The rolling circle 8 of the gearwheel has a radius RH. The rolling circle 9 of the annular gear has a radius RK. Furthermore, a first base circle 27 which has a radius RB1 is provided. A first rolling circle 28 (RR1) rolls without slipping on this circle 27, as is known from U.S. Pat. No. 2,421,463. The radius RR1 corresponds to RB1/n, where n is the number of teeth of the gearwheel. The rolling circle 28 has a midpoint 29. The midpoint of a circle 30 of a set of circles not illustrated more specifically is found at the fourth point of the parallelogram, which is otherwise determined by the points 6, 7 and 29. This circle 30 has a radius RT1. The line of intersection of the circle 30 with a straight line 31 between the contact point P between the two rolling circles 8 and 9 and the midpoint of the circle 30 is a point of the tooth tip 10 of the external tooth 4. Further points are produced in that the rolling circle 28 rolls on the base circle 27, or that is to say in that the rolling circle 8 rolls anticlockwise in the rolling circle 9.

Also shown is an angle of tilt VK1 which is bounded by the connection between the midpoint 7 of the annular gear 3 and the midpoint of the circle 30 on the one hand, and by a straight line through the midpoint 7 and the contact point P on the other hand. This angle of tilt is subsequently a measure of the distance from the diametral line of the sealing point 24 lying opposite the tooth tip-to-tooth tip sealing point 23.

A trochoid change-over is shown by means of a second base circle 32 which has a larger radius RB2 than the first base circle 27. A second rolling circle 33 having a midpoint 34 and a radius RR2 rolls on this second base circle 32. A circle 35 of a radius RT2 is drawn around the fourth point of the parallelogram otherwise formed by the three midpoints 6, 7 and 34. The radius RT2 is selected so that the circle 35 intersects the line 31 at exactly the same point as the circle 30.

A first trochoid is generated by means of the first rolling circle 28 on the base circle 27; by means of the set of circles formed by the circles 30 the trochoid determines the form of the tooth tip 10 of the external teeth 4. A second trochoid is determined by the second rolling circle 33 which rolls without slipping on the second base circle 32; by means of the set of circles formed by the circles 35 the second trochoid determines further parts of the external teeth 4, for example, the flanks thereof. Yet more trochoids which determine other parts, for example, the tooth spaces between the external teeth 4, can be provided. The important point here is that no point of discontinuity in the tooth should occur as a result of change-over from one trochoid to another. This is achieved in that the "boundary circles" of the respective sets of circles intersect the same point on the straight line 31.

The generation of two tooth portions by means of two different trochoids is illustrated diagrammatically in FIG. 3. Here, a first trochoid 36 with the points P1–P6 is formed by the first rolling circle 28 rolling on the first base circle 27.

A second trochoid 37 is formed by the second rolling circle 33 which rolls on the second base circle 32. The points P1'–P6' are arranged on the second trochoid 37. The points P6 of the first trochoid 36 and P1' of the second trochoid 37 lie on the same straight line 31, which also passes through the contact point P between the rolling circle 8 of the gearwheel and the rolling circle 9 of the annular gear. The rolling circles 28, 28' respectively for the starting and finishing point of the first trochoid 36 and the associated circles 30 and 30' respectively are illustrated, and similarly the rolling circles 33 and 33' respectively of the second trochoid 37 and the associated circles 35, 35' respectively of the set of circles generating the tooth flank. In this way the first trochoid generates the tooth tip 10, while the second trochoid 37 is responsible for generating the tooth flank 12. It is clearly recognisable that the circle 30' and the circle 35 intersect the line 31 at the same point, producing here a smooth transition on the tooth form. The change-over from one trochoid 36 to the other trochoid 37 does not therefore lead to any jumps or discontinuities in the tooth form. The second trochoid 37 can now be used for generating the tooth flanks and the tooth spaces. Only when a tooth tip is approached again during continued movement in the circumferential direction is a first trochoid 36 required again. During the transition from the second trochoid 37 to the first trochoid 36 a corresponding enlargement of the angle of tilt VK2 to VK1 (FIG. 2) is effected, thus compensating again for an angular displacement effected by the transition to the second trochoid 37. In FIG. 3 the direction of rotation of the rolling circle 8 in the rolling circle 9 is opposite to the direction in FIG. 1, to show that the circumferential direction has no bearing on generation of the tooth form.

In FIG. 2 a further circle 38 of radius RC is drawn in. The radius RC can be regarded as base circle for the annular gear 3. The radius RC corresponds to (n+1) times the radius RR1, that is to say, it corresponds to the radius RB1 of the first base circle 27 enlarged by the ratio of the number of teeth in the annular gear 3 and in the gearwheel 2. Using the radius RC of the circle 38, the curvature at the tooth tip 15 of the internal teeth 5 can now be determined. Using the radius RC and the eccentricity E, this radius RZ (FIG. 4) is given by the following equation $$RZ=\frac{(RC+(n+1)\times E)^2}{2\times(RC+(n+1)^2\times E)}$$

In this way it is possible for the tooth tips 10, 15 of external teeth 4 and internal teeth 5 to have substantially the same radius of curvature, that is to say RT1=RZ. Since the tooth tip 10 of the external tooth 4 has been formed with the aid of the first cycloid 36, strictly speaking, one cannot refer to a radius here. But the curvature remains in a region which is comparable with the radius RZ. Because the two tooth tips 10, 15 have substantially the same curvature, contact stresses, in particular Hertzian stresses, become less. This enables a uniform lubricating film to form. Wear is largely avoided here. Any potential residual wear is distributed uniformly over the two components annular gear 3 and gearwheel 2. At the same time, there is a relatively long sealing point in the circumferential direction so that leakages here can be kept very small. A relatively good volumetric efficiency is consequently achieved.

Since the form of the external teeth 4 has been described using FIGS. 2 and 3, the construction of the internal teeth 5 of the annular gear 3 and the tooth flanks thereof are now described in conjunction with FIGS. 4 and 5. The tooth tip 15 is a section of a cylinder with a radius of curvature RZ=RT1, that is to say, this radius corresponds to the radius of the circle 30 used to generate the tooth tip 10. In this way the curvature of the tooth tip 10 of the internal tooth 4 corresponds to the curvature of the tooth tip 15 of the external tooth 5. Similarly, the bottom land 19 can likewise be formed by a section of a cylinder. The radius of this section of a cylinder can be smaller than the radius of the circle which touches the deepest points of the tooth spaces 18 (FIG. 1*b*), that is to say, the points that are furthest from the midpoint of the annular gear 3. To simplify the description, end points 39, 40 are introduced for tooth tip 15 and bottom land 19 respectively. These end points 39, 40 mark the transition from the tooth tip 15 and the bottom land 19 to the tooth flank 17. The end points 39, 40 can be formed by cylindrical segments of a small radius of curvature which produce a relatively sharp edge. The formation of an acute angle should be avoided, however.

The slope of the tooth flank 17 at the transition between the bottom land 19 and the tooth flank 17 is determined by a normal 41 on a tangent 42 to the rolling circle 9 of the annular gear 3, the tangent 42 passing through the end point 40. In principle, it is also possible for the tangent 42 to the rolling circle 9 to be replaced by a secant. However, this would cause the slope of the tooth flank 17 to be less steep at this point. The optimum slope of the normal 41 and consequently of the tooth flank 17 can be achieved using the tangent 42.

The slope of the tooth flank 17 at the other end point 39, that is, at the transition between the tooth tip 15 and the tooth flank 17, is determined by a radial ray 43, that is, by a straight line through the midpoint 7 of the rolling circle 9 and the end point 39. The transition between the two end points 39 and 40 can be formed by an S-curve.

This S-curve, as shown in FIG. 5, can be formed by at least two arc segments 44, 45 which, like the tooth flanks of the external teeth 5 in FIG. 2, can be generated by rolling circles rolling on one another. However, in this case it is sufficient, for example, for only one of the arc segments, here segment 45, to be formed by an involute (FIG. 5). The end point 39 of the tooth tip 15 and the slope of the flank there are fixed by the radial ray 43. The arc segment 44 can be formed by a segment of an arc of a circle which touches this tooth tip tangent 43 and the arc segment 45. Such an arc of a circle can be easily constructed. The S-curve, which determines the tooth flank 17, is then composed of two arc segments 44, 45, of which one 45 starts from the end point 40 and the second 44 starts with the opposite curvature from the end point 39. At their contact point 17, both arc segments 44, 45 have the same tangent. Since two points 39, 17 with associated tangents are then available for the arc of a circle 44, the arc of a circle 44 can be easily constructed.

The contact between the gearwheel 2 and annular gear 3 is restricted to the two sealing regions 23 and 24, that is, in the sealing region 23 only the two tooth tips 10, 15 of the external teeth 4 and the internal teeth 5 touch, while in the sealing region 24 only the tooth flanks 11, 12 and 16, 17 touch.

To construct the machine, the procedure can be as follows, for example. After deciding on the number of teeth for the gearwheel 2, which in this embodiment has been selected to be even, and for the annular gear 3, the width of the tooth tip 15 of the internal teeth 5 in the annular gear 3 is selected. The tooth tips 15 need only be the width required for sealing. The curvature of the tooth tips 15 is provided by the above-mentioned equation for RZ. In dependence on the radius RC used in the connection, the base circle 27 and the rolling circle 28 for the trochoid 36 for generating the tooth tip 10 of the external teeth 4 of the gearwheel 2 are chosen.

The construction of the tooth tip is effected as given in U.S. Pat. No. 2,421,463. The tooth tips 10 then have approximately the same curvature as the tooth tips 15 of the internal teeth. The tooth spaces 18 in the annular gear 3 are selected to be wide enough for the tooth tips 10 of the gearwheel 2 to engage therein. The tooth spaces 18 can, as shown in FIG. 1*b*, be made deeper by pockets 21 for oil under pressure, with the result that jamming can be avoided. The same applies to the tooth spaces 13 in the gearwheel 2. After the tooth tips 10, 15 have been constructed, the sealing point 23 is determined. There are several possible methods of constructing the sealing point 24, at which two tooth flanks engage with one another. In a first possibility, the tooth flank can be generated on the annular gear 3 by any curve, for example by the S-curve specified in combination with FIG. 5. After that, the second trochoid 37 (see FIG. 3) for the gearwheel 2 is determined. Alternatively, curves on the gearwheel can also be selected. A corresponding trochoid is then used for generating the tooth flank form for the annular gear 3. Mixed forms can also be used, in which the form of the tooth flanks is generated partially by curves, for example, circular curves, and partially by trochoid-based curves. Normally, cycloids are used for trochoids, that is, the rolling circles roll on base circles.

The steepness of the tooth flanks should be dimensioned so that the slope-created drive forces which arise through rolling of the flanks of internal teeth and external teeth against one another, have a beneficial effect on the area on which pressure acts indicated by the bar 22 in FIG. 1*a*. An improved seal at the sealing points 23 is achieved as a result.

The machine illustrated gives improved noise ratios. Wear is reduced. With otherwise the same volume there is a greater efficiency, that is, the volumetric performance is increased. Since a higher pressure can be used in the sealing regions 23, 24 because of the improved sealing conditions, there is also a greater torque. With an identical output compared with known machines, liquids of reduced lubricity can be used, since the formation of a lubricating film is given greater support by the structural features.

I claim:

1. In a hydraulic machine with a gearwheel having a midpoint and a predetermined number of external teeth with tooth tips and tooth flanks separated by tooth spaces, and an annular gear having a midpoint offset by an eccentricity with respect to the midpoint of the gearwheel and having a number of internal teeth with tooth tips and tooth flanks separated by tooth spaces which exceed by one the number of said external teeth, the gearwheel and annular gear orbiting or rotating relative to one another and at least the external teeth being created from a form using a set of circles lying with their midpoints on a trochoid, the improvement comprising at least two trochoids, displaced relative to one another in a circumferential direction, for generating a tooth profile, each trochoid being formed by a rolling circle and a base circle, the rolling circles of the trochoids and the base circles of the trochoids differing from one another.

2. A machine according to claim 1, in which a first trochoid is the basis of the set of circles forming the tooth tips of the external teeth.

3. A machine according to claim 1, in which the tooth tips of external teeth and internal teeth are substantially the same.

4. A machine according to claim 1, in which adjacent trochoids change discontinuously into one another at a transition point.

5. A machine according to claim 4, in which the difference at the transition point between the distance of the first trochoid from the contact point of two rolling circles of the gearwheel and the annular gear and the radius of a first associated set of circles is substantially the same as the difference between the distance of an adjacent trochoid from the contact point and the radius of a second associated set of circles.

6. A machine according to claim 1, in which, at least in one position, in which an external tooth and an internal tooth form a sealing point at their tooth tips, an opposing sealing point is displaced from a diametral line towards a tooth flank region.

7. A machine according to claim 6, in which a contact is formed between two surfaces in the flank region, one of the surfaces being convexly curved and the other of the surfaces being concavely curved.

8. A machine according to claim 1, having circumferential sections in which a tooth form is formed by base forms other than a trochoid-based sets of circles.

9. A machine according to claim 8, in which the base forms are created by segments of a circular curve.

10. A machine according to claim 8, in which the gear wheel and annular gear are complementary in that the circumferential sections of one of the gearwheel and the annular gear, which are formed by the base forms, are associated with circumferential sections of the other of the gearwheel and the annular gear and having a form constituted by a set of circles lying with their midpoints on a trochoid.

11. A machine according to claim 1, in which the tooth tips of the internal teeth are in the form of a section of a cylinder having a radius determined by the radius of the base circle of the trochoid for generating the tooth tips of the external teeth and by the eccentricity.

12. A machine according to claim 11, in which the radius of the section of a cylinder is defined by the following equation:

$$RZ = \frac{(RC + (n+1) \times E)^2}{2 \times (RC + (n+1)^2 \times E)}$$

in which

RZ is the radius of the section of a cylinder,

RC is the radius of a midpoint circle for a sector of teeth of the annular gear, E is the eccentricity, and n is the number of teeth in the gearwheel.

13. A machine according to claim 1, in which the tooth tips of the internal teeth extend over an angle of rotation that corresponds to a movement of the contact point of the rolling circles of the trochoids over approximately half a tooth pitch.

14. A machine according to claim 1, in which inclination of a tooth flank of the internal tooth at an end point of a tooth space bottom land corresponds to a normal on a tangent to the rolling circle of the annular gear which passes through the end point of the bottom land.

15. A machine according to claim 14, in which the inclination of the tooth flank at an end point of a tooth tip of the internal tooth corresponds to a radial ray through the midpoint of the rolling circle.

16. A machine according to claim 15, in which transition from the end point of the bottom land to the end point of the tooth tip is effected in the form of an S-curve.

* * * * *